US005177882A

United States Patent [19]

Berger

[11] Patent Number: 5,177,882

[45] Date of Patent: Jan. 12, 1993

[54] SHOE WITH A CENTRAL FASTENER

[75] Inventor: Christoph Berger, Egloffstein, Fed. Rep. of Germany

[73] Assignee: PUMA AG Rudolf Dassler Sport, Fed. Rep. of Germany

[21] Appl. No.: 715,464

[22] Filed: Jun. 14, 1991

Related U.S. Application Data

[63] Continuation-in-part of Ser. No. 532,278, Jun. 4, 1990.

[30] Foreign Application Priority Data

| | | | |
|---|---|---|---|
| Jun. 3, 1989 | [DE] | Fed. Rep. of Germany | 8906840[U] |
| Oct. 28, 1989 | [DE] | Fed. Rep. of Germany | 8912788[U] |
| Feb. 13, 1990 | [DE] | Fed. Rep. of Germany | 9001645[U] |
| May 15, 1990 | [DE] | Fed. Rep. of Germany | 9005496[U] |
| Nov. 30, 1990 | [DE] | Fed. Rep. of Germany | 9016325[U] |

[51] Int. Cl.[5] ..... A43B 11/00

[52] U.S. Cl. ..... 36/50.1; 36/54

[58] Field of Search ..... 36/54, 50, 51; 24/713, 24/712.1

[56] References Cited

U.S. PATENT DOCUMENTS

| | | | |
|---|---|---|---|
| 61,487 | 1/1867 | Vollschwitz | 36/50 |
| 1,408,563 | 3/1922 | Conger | 36/50 |
| 1,489,126 | 10/1922 | Jansizian | 36/50 |
| 1,494,653 | 7/1922 | Walters | 36/50 |
| 1,606,797 | 11/1926 | Juian | 35/54 |
| 2,345,057 | 3/1944 | Marinetti | 36/50 |
| 2,994,935 | 8/1961 | Buchholz | 36/50 |
| 3,738,027 | 6/1973 | Schoch | 36/50 |
| 3,808,644 | 5/1974 | Schoch | 24/685 K |
| 4,372,060 | 2/1983 | Adamik | 36/54 |
| 4,433,456 | 2/1984 | Baggio | 36/50 |
| 4,551,932 | 12/1985 | Schoch | 36/117 |
| 4,642,914 | 2/1987 | Caldera | 36/50 |
| 4,670,949 | 6/1987 | Autry | 24/140 |
| 4,726,126 | 2/1988 | Bernhard | 36/89 |
| 4,727,660 | 3/1988 | Bernhard | 36/88 |
| 4,811,500 | 3/1989 | Maccano | 36/50 |
| 4,817,303 | 4/1989 | Selbiger | 36/50 |
| 4,870,761 | 10/1989 | Tracy | 36/51 |
| 4,901,452 | 2/1990 | Wang | 36/50 |
| 4,961,544 | 10/1990 | Bidoia | 36/50 |
| 4,999,889 | 3/1991 | LeCouturer | 24/713.2 |

FOREIGN PATENT DOCUMENTS

| | | | |
|---|---|---|---|
| 2341658 | 3/1974 | Fed. Rep. of Germany . | |
| 2900077 | 7/1980 | Fed. Rep. of Germany . | |
| 3626837 | 2/1988 | Fed. Rep. of Germany . | |
| 3813470 | 2/1989 | Fed. Rep. of Germany . | |
| 1374110 | 8/1964 | France . | |
| 2501977 | 9/1982 | France | 36/50 |
| 265445 | 2/1927 | United Kingdom | 36/50 |

*Primary Examiner*—Steven N. Meyers

*Attorney, Agent, or Firm*—Sixbey, Friedman, Leedom & Ferguson

[57] ABSTRACT

A shoe, especially a sport, leisure or rehabilitation shoe, is provided with a central fastener that is attached on a dimensionally stable instep cover that is movable toward or away from the instep and which is configured for use on shoes having an upper formed of a material that is deformable under tensile stresses in at least a throat area. This is basically achieved, in accordance with a preferred embodiment, in that the central fastener (24) is provided with a holding plate (23), which is fastened to a soft elastic tongue (15) and stiffening or tensioning strips are attached to the upper along opposite sides of the throat area, and a rope-like tightening element runs, from the central fastener, along the opposite sides of the throat area, passing back-forth between guide elements on the stiffening or tensioning strips and the guide elements of the instep cover. The holding plate (23) is substantially smaller than the length of the instep (26). As a result, essential parts of the tongue (15) remain pliable.

38 Claims, 4 Drawing Sheets

SHOE WITH A CENTRAL FASTENER

CROSS REFERENCE TO RELATED APPLICATION

This application is a continuation-in-part of the present applicant's co-pending U.S. patent application Ser. No. 532,278, filed Jun. 4, 1990. The disclosure of this application is hereby expressly incorporated by reference.

BACKGROUND OF THE INVENTION

This invention relates to a shoe with a central fastener, especially a sport, leisure or rehabilitation shoe, with a central fastener provided on a rigid instep cover that is movable toward or away from the instep, and having a fastener from which a rope-like tightening element connected to it extends toward both sides and which can be brought back to the instep cover by a guide element provided on the side portions of the upper.

Such a shoe is known from German Auslegeschrift 23 41 658. There, a central fastening device in the form of a rotatable toggle is provided on a tongue-like middle upper of a ski boot which, for easier access at the toe, is connected to the foreshoe in a jointed manner. A tightening rope runs from this central fastening device both upward and downward, basically, crosswise to the middle upper. This tightening rope forms a loop on the outside and, after a crosswise return through the middle upper and after formation of another loop on the other side edge of the middle upper at the same height as the respective first loop, it is fastened to the middle upper. The loops, opposite one another, are located in the area of the bend of the foot at the end of the instep, i.e., in the joint at the transition to the lower leg. The two other loops are provided in the area of the ball of the big toe or of the metatarsophalangeal joints.

Hooks are formed on the upper material of the ski boot. In the position of the middle upper that can be swung against the upper, the loops are laid over the hooks and, by rotation of the toggle, the tightening rope is put under tension by a rope roller connected to the toggle and, thus, the ski boot is tightly closed. In this case, the tensile stress acts in each case perpendicular to the extension of the middle upper, which in each case covers the side uppers.

With this configuration, a good access is indeed possible in the open condition. But with closure, applying the loops over the hooks is bothersome and time-consuming and especially a problem when hooks are clogged with snow or ice.

Other ski boots with central closures are known from U.S. Pat. No. 3,738,270 and German Offenlequinqsschrift 3,626,837. These patents are discussed in the referenced co-pending application.

In the reference co-pending patent application, a shoe with an upper material that is deformable relative to tensile stresses in the closing area or with several deformable upper materials, i.e., flexible materials instead of the rigid ones used to form the shell-shaped upper parts of ski boots, especially sport, leisure or rehabilitation shoes, is provided with a central fastener. The central fastener is attached at a top end of the tongue of the shoe and a tightening element runs from the central fastener, through guide grooves or recesses, in the direction of the toe of the shoe alternately over a guide element of a side part of the shoe, then over a guide element at the tongue or crosses over the tongue, then runs at least over another guide element of the side part and, optionally, over other guide elements at the tongue, to the lower area of tongue and from where, in the case of a one-piece tightening element, it is brought back to central fastener along the opposite side of the tongue, or in case of a tightening element consisting of two sections, its ends are fastened there or on side parts.

SUMMARY OF THE INVENTION

With this invention, the primary object to be achieved is to configure a shoe with a central fastener of the above-mentioned ski boot type so that its use for shoes with an upper material that is deformable relative to tensile stresses in the closing area or with several deformable (flexible) upper materials, especially with sport, leisure or rehabilitation shoes, becomes possible in a further development of the invention described in the inventor's co-pending application, noted above.

A related object is to enable an especially good fit of the shoe to the foot, above all, in the instep area, to be made possible, so that, despite a good fixing of the foot in the shoe, the mobility of the foot in the area of the metatarsophalangeal joints and in the area of the upper and lower ankle joints is not restricted.

These objects are achieved by the use of the following features:

- the instep cover comprises a soft elastic tongue that form a padding;
- the tongue is deflectably fastened on a toe end of the upper material of the shoe;
- the central fastener is attached to a free center strip of the tongue by a holding plate made of a hard, dimensionally stable material (rigid);
- the length of the holding plate is at most 95% of the instep length;
- the holding plate is attached to the center strip of tongue so that at least 5% of the length of the center strip, between the front edge of the holding plate and the fastening point or lower end of the tongue on the upper material is exposed;
- the tightening element runs from the top lateral guide grooves or recesses in the direction of the toe of the shoe alternately over a guide element of a side part of the shoe, then over a guide element of the holding plate or of the center strip, or crosses over the holding plate, then runs at least over another front guide element of the side part and, optionally, over other guide elements of the holding plate or of the center strip, to the lower area of tongue where it is free of the holding plate, and from where, in the case of a one-piece tightening element, it is brought back to central fastener and fastened there or in case of a tightening element consisting of two sections, its ends are fastened there or on the side parts of the upper.

By the configuration according to the invention, the shoe remains flexible in the area of the metatarsophalangeal joints and the tongue, especially its center part. As a result of the soft elastic design, a good fit can be obtained over the entire instep length on the instep form, i.e., on the instep arch of the foot. Since the holding plate for the central fastener does not completely cover the instep length, and a lower portion of the tongue remains free and thus elastic, for shoes, which are not alpine ski boots, important mobility of the foot in the area of the metatarsophalangeal joints is assured. This applies because of the dimensioning of the length of the holding plate and for the unhindered mobility of the upper and lower ankle joint, which in shoes of the type according to the invention (also, in contrast with alpine ski boots) is not impaired and does not have to be completely eliminated at all.

Other objects, features and advantages of the invention will become apparent from the detailed description of the invention, below, when viewed in conjunction with the illustration of a preferred embodiment in the drawings.

DETAILED DESCRIPTION OF THE PREFERRED EMBODIMENT

In the following description, the term "instep length" is used to mean the distance between the upper and lower ankle joint and the metatarsophalangeal joints, as shown at the bottom right side of the illustration of FIG. 1.

Figures 1, 1A:
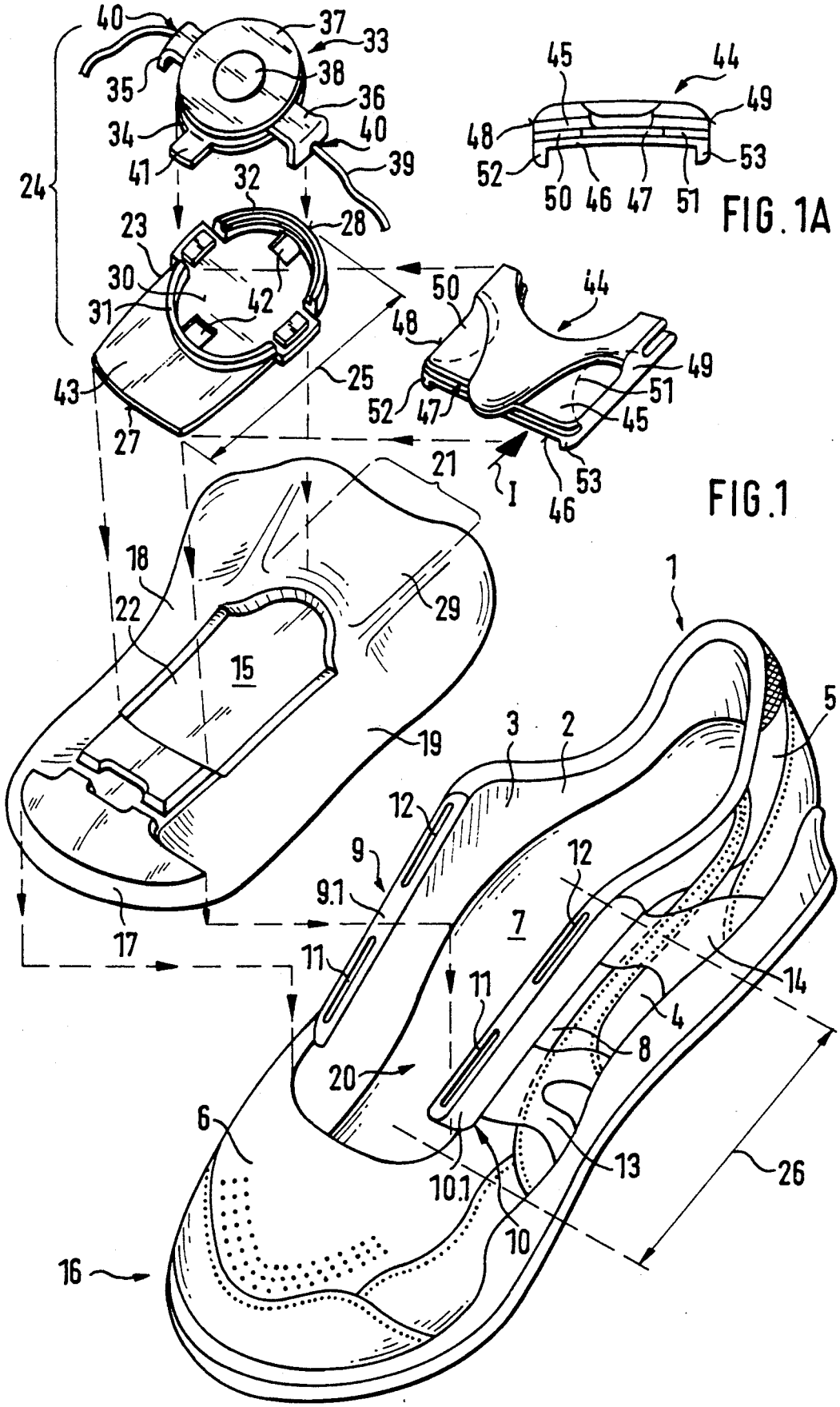
FIG. 1 is an exploded perspective view of the main components of a shoe and an associated central fastener in accordance with an embodiment of the invention.
FIG. 1*a* is an end view of a part of the central fastener seen in the direction of arrow I in FIG. 1.

In FIG. 1, a shoe 1 according to the invention is represented in an exploded view of its essential individual elements. Here, the shoe is, preferably, a sport, leisure or rehabilitation shoe, i.e., a shoe, whose upper, in contrast with an alpine ski boot, does consist of dimensionally stable (rigid) shell-shaped upper parts but whose upper consists of a uniform, deformable upper material or of several deformable upper materials, i.e., flexible materials such as leather, artificial leather, fiber fabric, optionally provided with leather or artificial leather trimmings. These sport or leisure shoes include, for example, training shoes, tennis shoes, jogging shoes or also special sport shoes such as running shoes, jumping shoes or the like.

By rehabilitation shoes or shoes for rehabilitation purposes are meant especially those shoes which make it possible, in the case of persons with foot injuries or who have had foot operations, for the rigid holding devices, such as plaster casts, orthotic devices or the like, to be able to be removed as soon as possible so that the patient is be able to walk again as quickly as possible, without renewed injuries or secondary injuries occurring, for example, by false walking positions because of the so-called "relieving postures." Such rehabilitation shoes are described in greater detail in U.S. Pat. Nos. 4,726,126 and 4,727,660.

The shoe 1, shown in FIG. 1, is comprised of a sole S, and an upper having side parts 3 and 4, a heel part 5, foreshoe 6 and an insole 7.

The edge 8 of the side parts 3, 4 ends in the instep area and is provided with a stiffening element 9, 10. Each stiffening element is formed by a tension strip 9.1 or 10.1 made of a flexibly deformable material in which a pair of longitudinal slots 11 or 12 is provided. Straps 13, 14 each extend from below the longitudinal slots 11, 12, and run over the side parts 3 or 4 of upper 2 to the area of sole S where they are fastened between the upper material and the sole material.

A cushioning tongue 15 of soft elastic material, preferably of a foamed plastic, is inserted into the throat (opening in the instep area) of the shoe upper and its end 17 that is directed toward toe 16, is shoved under the upper material and is deflectably fastened there by stitching, and optionally gluing. Side walls 18, 19 of tongue 15, thus, come to lie below the side parts 3, 4 of upper 2. By the removal of tension strips 9.1, 10.1 or by dimensioning of the height of edges 8 of side parts 3, 4 of upper 2, an opening 20 is formed which leaves a center strip 21 of tongue 15 free (exposed) even in a maximally closed position. This exposed center strip has a width of at least 1.5 to 2 cm.

A shallow depression 22 is provided in tongue 15, preferably, in a middle third of its upper surface, in which a holding plate 23 of a central fastener 24 is inserted and can be fastened there, for example, by gluing, stitching or sheathing. Holding plate 23 consists of a hard elastic dimensionally stable (rigid) and thus hardly or only slightly deformable material, especially of a hard compact plastic such as a polyamide, polyimide, polyethylene or the like. Length 25 of holding plate 23 and its arrangement on center strip 21 of tongue 15 is selected so that about 25% to 95% of the instep length 26 can be covered, but at least 5%, preferably 20% to 50%, of instep length 26 between the toe-directed, front edge 27 of holding plate 23 and fastened end 17 of tongue 15 remain free and therefore flexible. Moreover, according to a preferred embodiment, at least about 10% of the instep length 26 rearward of the heel-directed, back edge 28 of holding plate 23 remains free or is covered only by tongue 15 with a tongue part 29 extending in a direction toward the upper and lower ankle joint.

Holding plate 23 is provided with a support 30 in the form of a recessed base plate having arcuate rims 31, 32 annularly surrounding it. A closing part 33 can be inserted into this support 30 and, for example, can be fastened there by gluing.

Closing part 33 comprises a solid lower part 34 with lateral arms 35,36 and a rotatable adjustment knob 37. A winding device with a locking action is provided for a tightening element 39 and is located between the lower part 34 and the adjustment knob 37. Optionally, the winding device can produce an unlocking action by the application of pressure on button 38. The ends of a one-piece tightening element or for an end of two tightening element sections are connected to the winding device so that, by rotation of adjustment button 37, in one direction, tightening element 39 is wound up and by rotation, in the opposite direction it is unwound, as is known.

When the closing part 33 is mounted in the support 30, arms 35, 36 laterally engage over holding plate 23. A recess 40 for guiding the tightening element 39 is provided in each of the arms 35, 36 and/or in the support 30 located under them.

A catch lug 41 is formed on the lower part 34 at each of its front and rear sides (the rear side not being visible). The catch lugs of closing part 33 engage under rims 31, 32 through openings 42 of support 30, so that closing part 33 can be fastened to holding plate 23 by a catch connection. Holding plate 23 has a forwardly projecting extension 43. The extension 43, itself, or a double-shelled attachment 44 (represented in FIG. 1*a* as an end view in the direction of arrow I in FIG. 1) can be superposed on it and/or locked with it and/or glued to it and/or welded by an ultrasonic welding connection.

Between an upper shell 45 and a lower shell 46, a space 47 is provided which has an inside width which is the same or somewhat greater than the thickness of tightening element 39. The two shells 45, 46 are connected to one another on sides 48, 49 by guide elements 50, 51 for tightening element 39 provided or formed in space 47. Preferably, extension 43 and/or attachment 44, in each case, is formed of a one-piece construction, produced, for example, by an injection or die-casting molding process. Attachment 44 can be provided on each side 48, 49 with a downwardly projecting fixing tab 52, 53.

Figure 2:
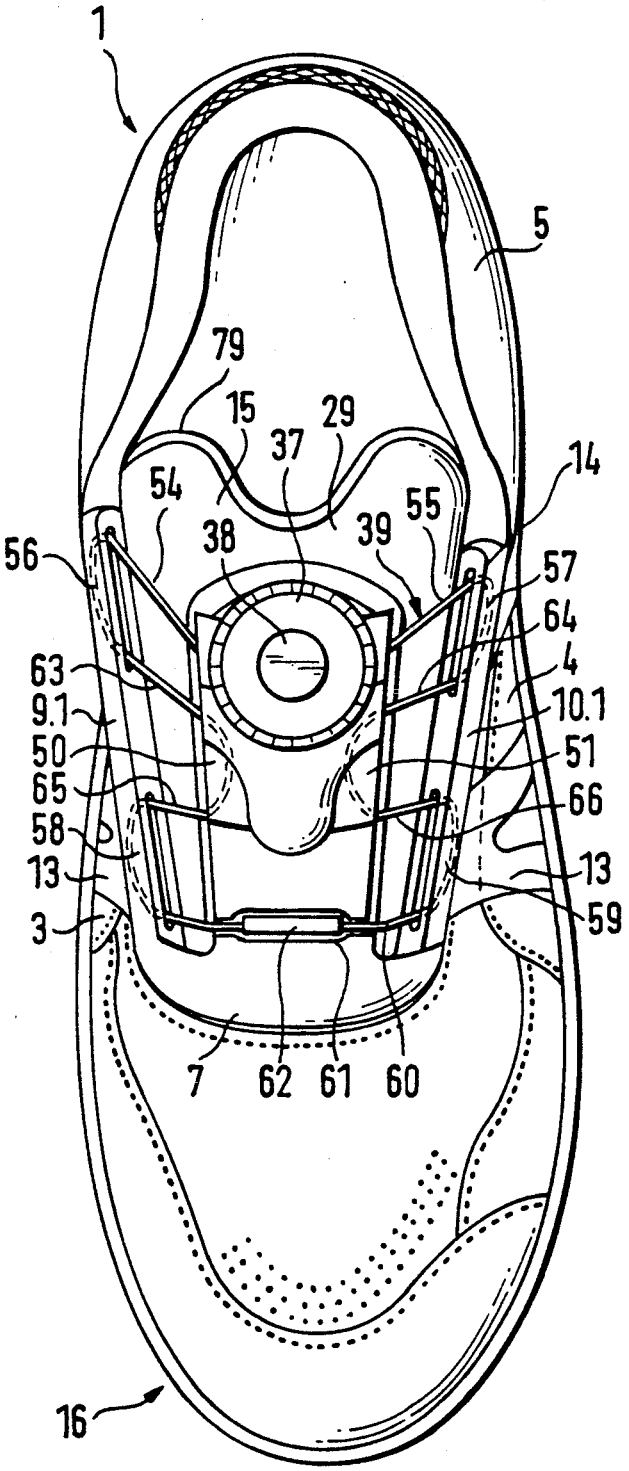
FIG. 2 is a top view of the shoe of FIG. 1 in assembled form.

When assembled, the tightening element 39 has first tightening element sections 54, 55 which, after having first been passed through the guide groove of holding plate 23 and/or of recess 40 of arms 35, 36 on lower part 34 of closing part 33 starting from the adjustment knob 37 of the central fastener 24, form upper lateral loops over the guide elements 56, 57 lying closest to the heel on the side parts 3, 4, together with following portions 63, 64. From tightening element portions 63, 64, the tightening element extends forwardly from the rear through space 47 of attachment 44, over the guide elements 50, 51 as is illustrated in FIG. 2. From guide elements 50, 51, the tightening element portions 65, 66 are directed to and over front guide elements 58, 59, and finally, from them to the front part of center strip 21 of tongue 15. In a one-piece tightening element 39, a returning section 60 lies in a crosswise groove 61 of center strip 21 of tongue 15. Additionally, a tube section 62 can be shoved over it there. Also, section 60 can be secured against lateral shifting in crosswise groove 61.

FIG. 2 shows a top view of a shoe 1 assembled from the individual parts of FIG. 1. Tongue 15 is approximately matched in cross section to the curvature of the instep of a foot, and its side walls 18, 19 cover at least about 60% of the instep area visible from above. At the same time, the top surface of side walls 18, 19 serves as a sliding surface for the adjacent side parts 3, 4.

Although, in the embodiment according to FIG. 2, only two guide elements are provided in each side part 3 or 4, it is possible to place additional guide elements there, which would coact with additional guide elements on the holding plate 23. Also, it is basically possible, to configure the guiding of tightening element 39 so that, for example, tightening element sections 63, 64 or 65, 66 cross one another in an area of holding plate 23 located under central fastener 24.

With a tightening element 39, consisting of two separate tightening element sections, their lower ends are fastened, in the area of crosswise groove 61, on either tongue 15 or on side parts 3, 4.

As can be seen in FIG. 2, at least the two top lateral tightening element portions 54, 55 of tightening element 39, but preferably also the directly following tightening element portions 63, 64 are provided to run from their guides on holding plate 23 or from center strip 21 of tongue 15 obliquely rearward to the respective guide elements 56, 57 or 50, 51 provided there. In this way, the tensile stress, occurring in the top or in the two top tightening element portions 54, 55 or 63, 64, in closing, is guided in the direction of heel part 5. In this case, straps 13, 14, preferably, are also arranged so that the tensile stress, on the one hand, runs directed downward to the sole and, on the other hand, backward to heel 5.

The other tightening element portions 65, 66 or 60 preferably run, from the holding plate 23 or from the center strip 21 of tongue 15, in top view, obliquely forward or crosswise relative to tongue 15.

To guarantee an effective transference of the tensile stress to the straps 13, 14, the respective guide elements 56, 57 and 58, 59 are, preferably, formed as part of a headpiece 67 of each strap 13, 14, as illustrated in FIGS. 4 to 8. Each headpiece 67 is put into a lower insertion slot 68 of tension strip 10.1, opposite longitudinal slot 11 or 12, and locked in place by a catch 69 engaging the lower edge 70 of insertion slot 68.

A stop 71, for example, in the form of a tab, on which front edge 72 of headpiece 67 can strike after bridging a certain clearance of a few millimeters, is located inwardly of slots 11, 12 in a direction of insertion of tightening element 39.

An edge 75 is provided on an upper surface 73 of guide elements 56, 57 or 58, 59. Edge 75 projects over peripheral area 74 of these guide elements and thus, forms a groove 76 for tightening element 39 that runs flush in a plane with slots 11 or 12. Projecting edge 75, on the side opposite front edge 72 of headpiece 67, is separated from the remaining material of strap 13 or 14 by a slit 77 for insertion of tightening element 39.

Tension strips 9.1, 10.1 are each, advantageously, provided with a formed-on fastening tab 78. With these fastening tabs 78, they can be stitched and/or glued and/or riveted to the upper material. Fastening tabs 78, preferably, are formed so that they run in a plane below slots 11, 12 or insertion slot 68 and their surface is flush with lower edge 70 of insertion slot 68.

Figure 3:
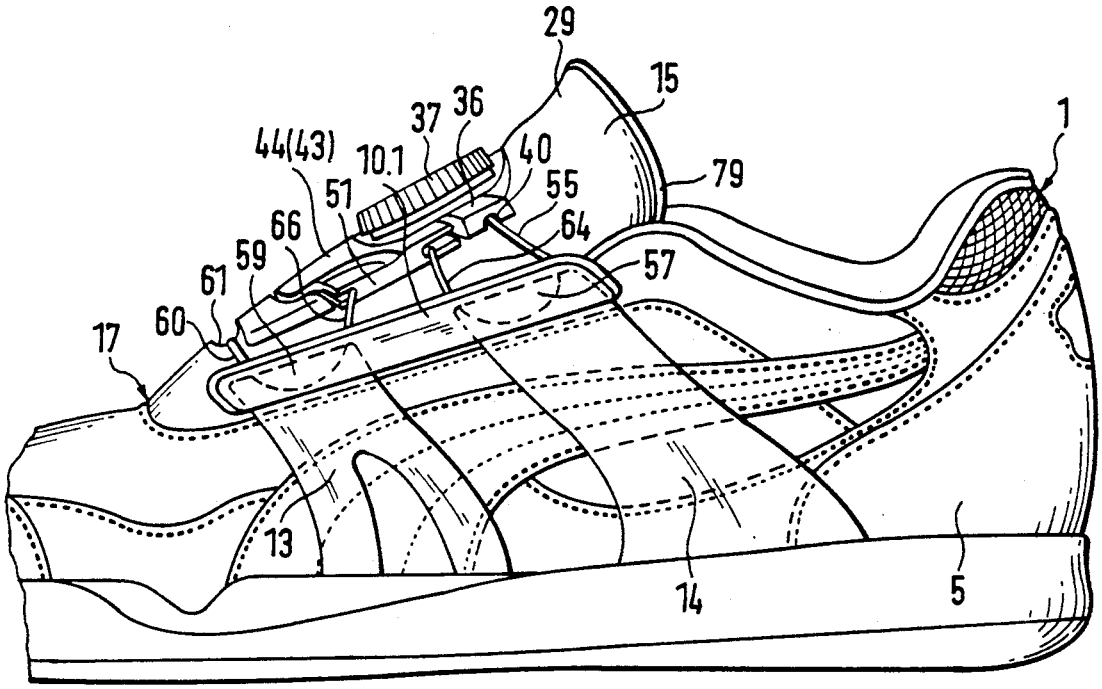
FIG. 3 a partial side view of the shoe of FIG. 2.
Figure 5:
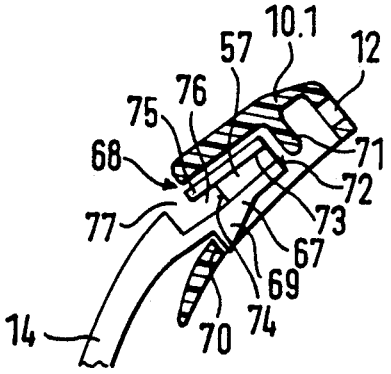
FIG. 5 shows a section through the tension strip taken along line II—II of FIG. 4.
Figure 6:
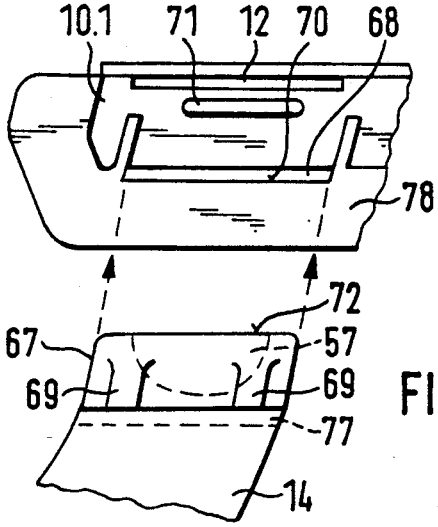
FIG. 6 is a partial view of the tension strip and the related headpiece of a strap.
Figure 4:
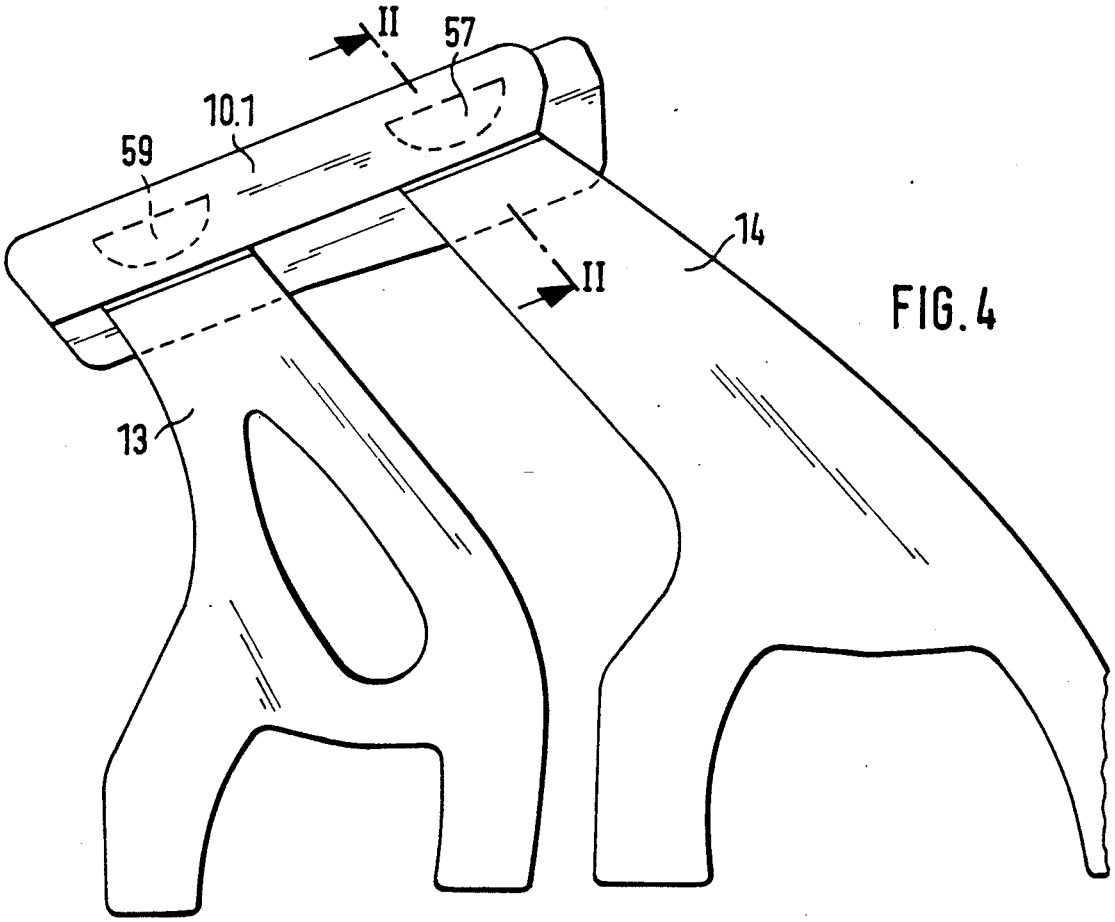
FIG. 4 is a side view of straps used with a tension strip prior to assembly into the shoe shown in FIGS. 1–3.

Tongue 15, advantageously, consists of a foamed polymer, preferably, of a thermoplastic, pressure-transmitting cushioning material in the form of foamed polyethylene, polyurethane or ethylene vinyl acetate. Tongue 15 can be provided on its underside with a textile lining 79, as FIGS. 2 and 3 show. In the same way, the upper surface of tongue 15 can also be covered at least partially with a textile layer, with leather or with other commonly used shoe materials, and especially, it can be lined with such a material.

Stiffening elements 9, 10 or tension strips 9.1, 10.1, preferably, are formed of flexible plastics, especially a polyamide, polyimide, polyurethane or the like. This also applies to straps 13, 14, which, preferably, consist of said plastics in a transparent form so that the trademark markings on the shoes remain visible.

By providing the embodiment of the invention represented in FIG. 1 to 6, with a mechanical connection of the stiffening elements 9, 10 or of tension strips 9.1, 10.1 with straps 13, 14, and by them with the upper and/or sole material, a width regulating system is obtained, with which the inside dimensions of the shoe upper can be exactly matched to the peripheral measurement of the foot. In this case, central fastener 24 performs a multiple function. It serves not only for production of a adjustable closing pressure that is uniformly distributed over the entire shoe but, also, at the same time, it causes an increased stability of the complete shoe in the sense that the danger of straining sensitive joints and tendons, especially in the shoe outside area, is reduced to the greatest possible extent.

It is especially advantageous that above-described central fastener 33, together with tightening element 39, basically, can be detached from holding plate 23 and, in practice, can be replaced like a shoe lace. As a result, central fastener 33 with tightening element 39 can be completed as a partial element of the shoe according to the invention, and can be tested for serviceability. Still, central fastener 33 with tightening element 39 can also be replaced after assembly of shoe 1, like a kit system. As a result, the error rate or rejection ratio is considerably reduced, which for a "High-Tech" shoe of this type is especially important.

Soft elastic tongue 15, provided as instep cover, forms a pressure damping intermediate member between the comparatively rigid holding plate 23, acted on by the tension forces, and the shoe wearer's foot. Holding plate 23 is formed of a hard, dimensionally stable (rigid) material, which, preferably, has a Shore hardness of 60 to 80 Shore D. Consequently, holding plate 23, on the one hand, acts as a pressure distribution element without, on the other hand, the deflectability of tongue 15 being made difficult at lower tongue end 17. Tongue 15 is made of a softer material than holding plate 23, and thus, it has a Shore hardness well below 60 Shore D.

Numerous other modifications and embodiments in keeping with the present invention will be apparent to those skilled the art. Thus, the present invention should not be viewed as limited to the details of the described embodiments and, instead, is intended to encompass the full scope of the appended claims.

What is claimed is:

1. Shoe, having an upper formed of a flexible upper material, of a type used for sport, leisure and rehabilitation shoes, comprising a central fastener provided on an instep cover that is movable toward and away from an instep, and having a tightening member from which a ropelike tightening element connected to it extends toward each of opposite side portions of the upper of the shoe wherein:

A) the instep cover is formed of a soft elastic tongue comprised of a padding;

B) a lower end of the tongue is deflectably fastened to a toe end portion of the upper material of the shoe;

C) the central fastener is attached to an exposed center strip of the tongue by a holding plate made of a hard, dimensionally stable material;

D) the length of the holding plate is at most 95% of a corresponding length of the instep;

E) the holding plate is attached to the center strip of the tongue in a manner leaving at least 5% of the length of center strip, between a lower front edge of holding plate and the lower end of the tongue uncovered; and F) the tightening element runs, on each side of the tongue, from a lateral guide at the central fastener, in a direction toward the toe of the shoe, alternately over a top guide element of a side part of the shoe, then over a guide element on one of the tongue and the holding plate, and then at least over another guide element of the side part to the lower end of the tongue where it is free of the holding plate.

2. A shoe according claim 1, wherein the tightening element is a one-piece tightening element, each end of which it fastened to the central fastener.

3. Shoe according to claim 1, wherein the tightening element comprises two sections, a respective one of the sections being provided at each side of the tongue, an upper portion of each section being fastened to the central fastener and a lower portion of each section of the tightening element being held in proximity to a lower end of the tongue.

4. Shoe according to claim 1, wherein at least a top portion of the tightening element at each side of the tongue, as seen in a top view of the shoe, runs obliquely toward a heel of the shoe from the guide element on one of the tongue and the holding plate to the top guide element of the side parts of the upper so that tensile stresses occurring on closing of the central fastener are directed in toward the heel.

5. Shoe according to claim 4, wherein tightening element portions other than said top portion, in top view, run in one of obliquely forward and crosswise directions relative to the tongue from the tongue toward the side parts.

6. Shoe according to claim 1, wherein at least one strap is provided at each side of the shoe extending from the guide elements of the side parts of the upper into the sole area of the shoe.

7. Shoe according to claim 6, wherein portions of the tightening element running from the guide elements on one of the tongue and the holding plate to the guide element of the side parts of the upper extend in a generally parallel direction relative a respective said strap.

8. Shoe according to claim 6, wherein said straps, in top view, run obliquely rearward from the guide elements.

9. Shoe according to claim 6, wherein at least one of the guide elements of each of the side parts is formed on a headpiece of a respective strap.

10. Shoe according to claim 8, wherein edges of the side parts of upper are stiffened by stiffening elements that are limited to an instep area.

11. Shoe according to claim 10, wherein the stiffening elements have guide slots through which the tightening element passes and loops around a guide element of a respective headpiece of a strap.

12. Shoe according to claim 11, wherein the headpiece of the strap is located in an insertion slot in the stiffening element on a side of the stiffening element opposite the guide slots.

13. Show according to claim 12, wherein each headpiece has a catch which, in an inserted condition of the headpiece, locks on a lower edge of a respective one of the insertion slots.

14. Shoe according to claim 12, wherein at least one stop for an edge of the headpiece of the straps is provided inwardly of the insertion slots.

15. Shoe according to claim 14, wherein the guide element provided on the headpiece of each strap has an upper surface with a projecting edge that extends over a peripheral area of the headpiece to form a groove for the tightening element that runs in a common plane with the insertion and guide slots.

16. Shoe according to claim 15, wherein the underside of the tongue is provided with a textile lining.

17. Shoe according to claim 15, wherein the projecting edge on a side facing the respective strap on which it is provided is separated from the material of strap by a slit for insertion of the tightening element.

18. Shoe according to claim 10, wherein the stiffening elements each form an individual tensioning strip.

19. Shoe according to claim 10, wherein the stiffening elements are made of a flexible plastic.

20. Shoe according to claim 11, wherein the stiffening elements have a fastening tab.

21. Shoe according to claim 15, wherein the fastening tab runs below a plane containing the insertion and guide slots, and has an upper surface that is flush with a lower edge of the insertion slots.

22. Shoe according to claim 1, wherein the tongue is formed of a foamed polymer.

23. Shoe according to claim 21, wherein the tongue has a depression on an upper surface thereof, said holding plate of the central fastener being inserted and is fastened in the depression with glue.

24. Shoe according to claim 21, wherein a top surface of side walls of the tongue form a sliding surface for supporting the side parts of the upper.

25. Shoe according to claim 1, wherein the holding plate has a support to which a central closing part, provided with an adjustment knob for the tightening element, is clipped and locked.

26. Shoe according to claim 25, wherein the central closing part has an arm at each of opposite lateral sides, and wherein at least one of each arm and a part of the holding plate located under the respective arm has a recess for the passage of the tightening element.

27. Shoe according to claim 25, wherein the holding plate has an extension disposed forwardly below the shell and a lower shell; wherein the shells are connected together on each side by a respective said guide element; and wherein a space is defined between the shells of an inside height which is at least as great the thickness of the tightening element.

28. Shoe according to claim 27, wherein the double-shelled attachment is formed of a one-piece construction including the respective guide elements, and wherein said attachment is attached, as a separate component, to extension the of holding plate.

29. Shoe according to claim 28, wherein the doubled-shelled attachment has a fixing tab on each side, said fixing tab projecting downward and engaging over side edges of the extension of the holding plate.

30. Shoe according to claim 28, wherein the double-shelled attachment is attached to the extension of the holding plate by one of an ultrasonically welded and glued connection.

31. Shoe according to claim 28, wherein the double-shelled attachment is attached to the extension of the holding plate by a locking connection.

32. Shoe according to claim 1, wherein the tongue, in cross section, is shaped to conform to an instep arch of a foot.

33. Shoe according to claim 1, wherein the tightening element is connected with a central closing part of the central fastener and is guided in a top lateral guide groove at each side of the holding plate.

34. Shoe provided with a closing device having an upper that is formed of a flexible material at least in side portions thereof in a throat area, an instep cover which covers an instep area and is flexibly connected to the upper at a bottom part of the throat area, and a tightening element by which the instep cover is adjustably fastenable to the side portions of the upper at each side of the instep cover; wherein the instep cover comprises at least a central portion which is formed of a rigid, dimensionally stable material and a flexible lower portion; wherein the closing device comprises a central fastener which forms a means for drawing the side portions of the upper toward the instep cover by the tightening element; wherein the central fastener is provided on the portion of the instep cover which is formed of said rigid, dimensionally stable material; wherein guide elements for the tightening element are provided on plastic strips attached to the side portions of the upper along opposite sides of the throat area and on said portion of the instep cover that is formed of said rigid, dimensionally stable material, said tightening element running form a top part of the throat area to a lower part of the throat area passing alternately over a said guide element on the side portions of the upper and a said guide element on the instep cover.

35. Shoe according to claim 34, wherein the plastic strips terminate above a lower end of the instep area.

36. Shoe according to claim 35, wherein the plastic strips are connected to an area of a sole of the shoe by tightening straps.

37. Shoe according to claim 34, wherein the instep cover is a padded tongue upon which a holding plate of said dimensionally stable material is attached, said holding plate carrying said central fastener the guide elements of the instep cover.

38. Shoe according to claim 35, wherein the tightening element comprises a single rope-like tightening member which runs from the central closure, down along one side of the throat area, across a lower end of the tongue and back up along an opposite side of the throat area to the central fastener.

* * * * *